United States Patent [19]

Patrick

[11] 3,973,514

[45] Aug. 10, 1976

[54] STOCK CONTROL INDICATING MEANS

[76] Inventor: John L. Patrick, 215 S. 29th St., Tacoma, Wash. 98402

[22] Filed: Feb. 24, 1975

[21] Appl. No.: 552,058

[52] U.S. Cl. ..... 116/133; 40/70 R; 116/129 F

[51] Int. Cl.[2] ..... G09F 9/00

[58] Field of Search ..... 116/130, 129 R, 114 R, 116/131, 133, 129 E, 129 F; 40/70 R, 5

[56] References Cited

UNITED STATES PATENTS

| | | | |
|---|---|---|---|
| 240,297 | 4/1881 | Baker | 40/5 |
| 1,749,418 | 3/1930 | Decker | 116/133 |
| 2,023,934 | 12/1935 | Molse, Jr. | 116/129 F X |
| 2,537,782 | 1/1951 | Meyers | 116/130 |
| 2,787,069 | 4/1957 | Ferguson et al. | 40/70 R |
| 2,935,804 | 5/1960 | Duckro | 40/16 X |
| 3,297,249 | 1/1967 | Light | 40/70 R X |
| 3,399,893 | 9/1968 | Payne | 116/129 R X |

FOREIGN PATENTS OR APPLICATIONS

| | | | |
|---|---|---|---|
| 511,262 | 3/1955 | Canada | 116/129 F |

*Primary Examiner*—Richard E. Aegerter
*Assistant Examiner*—Michael H. Thaler
*Attorney, Agent, or Firm*—Christensen, O'Connor, Garrison & Havelka

[57] ABSTRACT

This invention has to do with a stock indicator which includes a strip that will take writing and erasure and which includes printed legends such as "Part No.", "Quantity" and "Date", each associated with blanks to be filled in by pen, pencil or crayon. Such a strip may be designed to provide a counter dial or dials, or may be associated with a separate strip or strips which provide a readily readable dial or dials. Associated with each such dial is a rotary indicator member manually operable step by step in one direction as associated items are withdrawn, and in the opposite direction when items are added or replaced. Indicator devices of this nature may be made at very small cost, and each can be permanently associated with a particular shelf section or bin, or transferred from one stock collection to another if reorganization is required.

2 Claims, 7 Drawing Figures

STOCK CONTROL INDICATING MEANS

This invention relates to stock control means in stock or sales rooms where articles are withdrawn from stock, and may be placed in, or returned to stock, only by stock and/or sales clerks.

It is the primary purpose of the invention to provide simple, reliable, inexpensive and readily understood indicating means for maintaining a running record of the quantity of each identifiable item on hand.

For each shelf compartment or group of compartments devoted to a particular item, there should be a marker indicating the part number, the date of last replenishment and the number of items or packages then on hand. To this end a strip is desirably provided on a shelf edge, preferably white and of a material such as Bristol board, roughened celluloid or other suitable plastic which will take writing and erasure. Such a strip should desirably bear printed legends such as "Part No.", "Quantity" and "Date", each followed by a suitable writing space.

Of more significance, however, I provide, either integrally with such a strip, or separately but closely associated with it, a dial strip which rotatively bears a manually operable indicator member. The dial strip may bear a single dial, suitably graduated, either by printed numerals or by its physical structure, in association with a related rotatable indicator, to reveal readily a count of the items or packages on hand, or a count of the number of items sold since the indicated replenishment date.

If the quantity of a particular item demands it, two or more denominationally related dials may be provided side by side on a single dial strip. Alternatively, a plurality of separate, single dial strips may be mounted side by side and used in a denominational relationship.

In a preferred form of the invention, each dial strip, or each dial section of a multiple dial strip, is formed with a circular opening. Integral radial members which extend across said opening support an inner circular bearing portion. The radial members are evenly spaced from one another and short inwardly projecting indicator teeth subdivide the spaces between radial members evenly, thereby indexing the device and making it as readily readable for quantity as if printed numbers were provided.

A further feature embodied in the preferred form of the invention has to do with a very simple and secure way of mounting the indicator member on the dial strip. The hub portion of the dial strip is formed with a small central indicator bearing opening. An open sector of considerably larger size communicates with the central opening through a passage of very restricted width. The rotary indicator member has an inner end portion which is too large to pass through the central opening of the dial strip hub, said inner end portion being connected to the body portion of the indicator through a neck which can be acommodated by the central opening of the dial strip but which is normally too thick to occupy the passage through which it must pass in order to enter such central opening. It can, however, be squeezed through such passage under a considerable deforming pressure, and has no tendency to escape accidentally after being lodged there.

A still further feature of the preferred form of the invention has to do with means for arresting the indicator member in alignment with each one of the radial members and with each one of the indicator teeth of the associated dial member. To this end humps are provided on the outer face of the hub portion of each dial, the humps being so spaced and located that a recess is provided between humps in angular alignment with each radial member and with each indicator tooth of the dial member. The indicator tends to come to rest after passing each hump.

Other objects and advantages will hereinafter appear.

In the drawing forming part of this specification,

Figure 1:
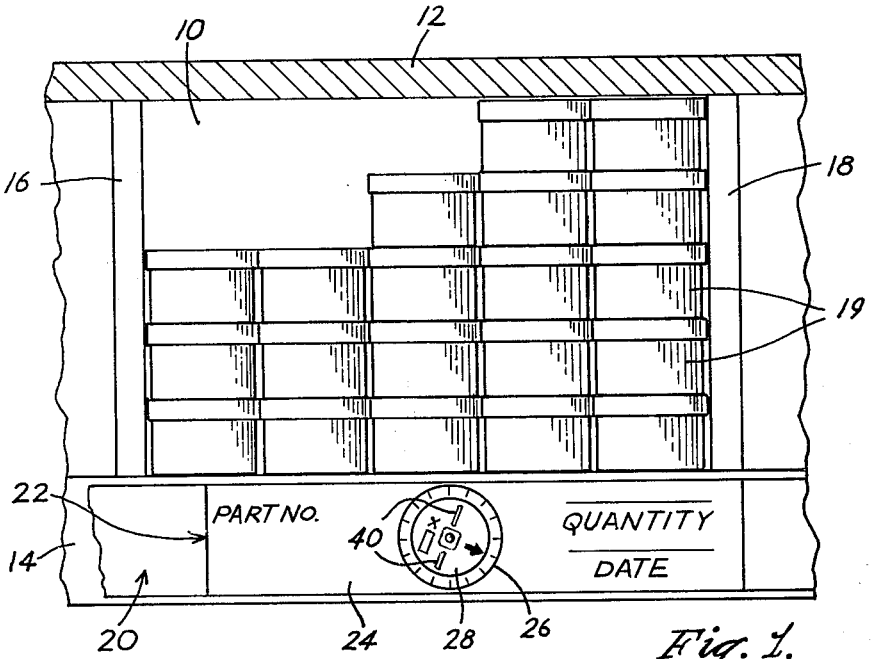
FIG. 1 is a fragmentary view in front elevation showing a stock compartment and an associated stock indicator which embodies significant features of the invention.

In FIG. 1 a stock compartment 10, which may be one of many, is shown. The compartment shown is bounded by a ceiling 12, a shelf 14 which may be an inch thick, and vertical walls 16 and 18. The compartment is arbitrarily shown as containing twenty packages 19, each containing, say, eight items of any specific description.

The shelf 14 is desirably equipped with a metallic strip 20 of conventional design. Strips of this kind are commonly provided for the receipt of conventional merchandise identification labels, but in the present instance they are utilized for holding my novel stock identification and counter devices. Such a device 22 comprises a flat flexible strip 24, desirably of Bristol board, or of celluloid having a roughened face which is adapted erasably to receive and carry written marks.

The strip 24, associated with a compartment well above eye level, has an area marked "Part No.". In this instance the area referred to is large enough to admit of large figures because the compartment is adjacent to the ceiling and well above eye level.

At the opposite end, the strip 24 bears the legends "Quantity" and "Date" in association with spaces which are to be filled in at the time when the compartment is initially stocked and to be replaced each time the compartment is restocked.

The more significant novel feature of my indicator strip involves the provision of one or more stock counters or indicators. A portion of the strip 24 is marked with a circular, indexed scale 26, having consecutively numbered indicator spaces, starting with a cipher.

A rotary indicator member 28 of small enough dimensions to expose the scale 26 is rotatably mounted, concentrically with the circular scale 26. The disc 28 may also be desirably composed of Bristol board or of face-roughened celluloid. It desirably includes raised portions 40 which may be engaged by a thumb or finger for turning the indicator disc either clockwise or counterclockwise.

Whenever a complete package is withdrawn or sold, the disc 28 is turned one number space clockwise. If a package is withdrawn from a compartment for showing it to a customer the indicator is turned one number space forward or clockwise. If the package is rejected it is returned to the compartment from which it had been taken, and the associated indicator is turned backward a step—counterclockwise.

When inventory is taken for the purpose of replenishment of stock, reference to the indicated date and the current date together with the depletion which has occurred in that period will reveal the rate of depletion and will serve as a guide for reordering.

When replenishment is effected the total quantity on hand and the date are altered to show the current condition, and the indicator is re-set to zero.

If an item which is normally sold in package lots is also sold as individual items, the associated couter or indicator will be set forward a notch when the package from which individual items are being dispensed is exhausted.

For the purpose of reordering, the number of packages, not the number of individual items, is generally the significant number. Each rotatable indicator, however, is advantageously provided with a "times" sign and a line for indicating the number of units to a package. This enables the stock on hand to be figured down to individual items for each category, when that figure may be required, as for tax computing purposes.

The single dial indicator 26-28 as shown in FIG. 1 is adequate for an item which does not sell rapidly. It is, in the illustrative instance, graduated with sixteen spaces numbered consecutively from zero to 15. This indicator is also adapted for a compartment well above eye level because it is provided with a large space for the part number.

Figure 2:
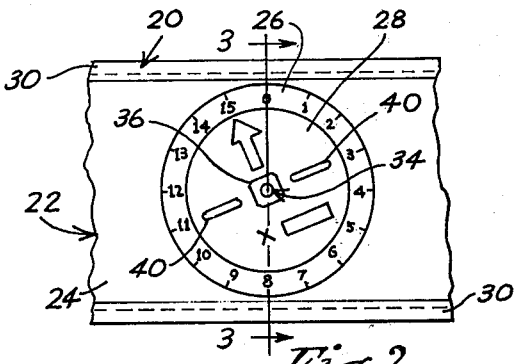
FIG. 2 is a fragmentary view in front elevation of the indicator of FIG. 1, on a substantially enlarged scale.

As will be seen best in FIG. 2, the conventional metallic strip 20 is formed to provide shallow upper and lower slots. Each slot is bounded on one side by the connecting solid body of the strip 20, and on the other by an inturned flange 30 of scant height. The vertical dimension of the strip 24 desirably exceeds by a slight amount the space between the bases of the upper and lower slots. The strip 24 is bent by the fingers for insertion in the slots and springs outward when released to bear frictionally against the bases of the slots.

The indexing disc 28 may be of generally circular form. It is rotatively mounted on the strip 24 in concentric relation to the scale on 26. A journal member 34 has an enlarged face portion 36 and a shank which is passed centrally through the disc 28 and the strip 24. A thin retaining member 38 is impaled upon the shank of the journal member 34. The face portion 36 of the journal member 34 is made thin and the indexing dial, which is desirably composed of celluloid, is formed with operating humps 40 which project forward beyond the face portion 36 of the journal member 34, so that the indexing disc 28 can be turned through finger pressure.

Each indexing disc, if of celluloid, is desirably provided with a roughened area or areas to take writing and erasure. The disc includes a "times" sign and an associated line on which the number of individual items included in each full package may be written. The celluloid disc, if desired, may conveniently be roughened on its entire outer surface.

The invention is susceptible of a wide variety of modifications, FIG. 4 being illustrative of an indicator for (a) a compartment at, below, or slightly above eye level, (b) adapted to contain a large number of packages, and (c) the utilization of a strip as wide as the shelf thickness and adapted for adhesive union to the face of the shelf.

Figure 3:
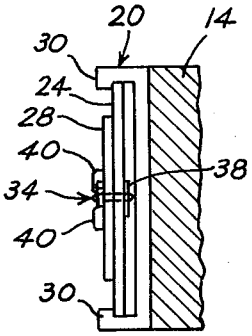
FIG. 3 is a view in sectional elevation on the scale of FIG. 2, the view being taken on the section line 3—3 of FIG. 2, looking in the direction of the arrows.
Figure 4:
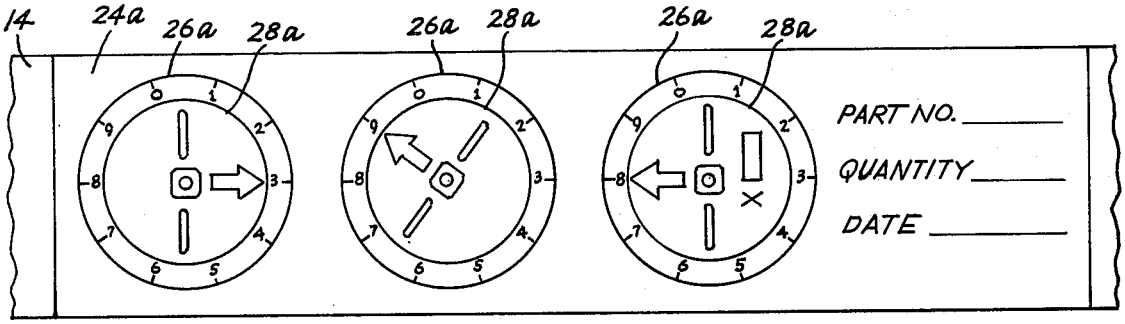
FIG. 4 is a view in front elevation showing an indicator which includes only one stock indicator dial.

The invention is not, or course, limited to the specific showing of FIGS. 1 and 2, and the specific showing of FIG. 3, since any one or more of the variations of FIG. 4 could be included in FIG. 1 so long as there is no conflict.

In FIG. 4, instead of providing a base strip of Bristol board or celluloid, a strip 24*a* of adhesive tape, equal in width to the thickness of the shelf, is adhered to the vertical face of the shelf.

The tape has printed upon one segment the legneds "Part No.", "Quantity" and "Date". The tape has printed on it a plurality (illustratively three) circular dials 26*a*, each graduated on a decimal basis (0 to 9), and the indicator members 28*a*, constructed and mounted as already described, are adapted to cooperate with the respective dials.

As before, the indicator disc of lowest denomination includes a "times" sign and a line on which the number of items contained in a package may be written.

Figure 5:
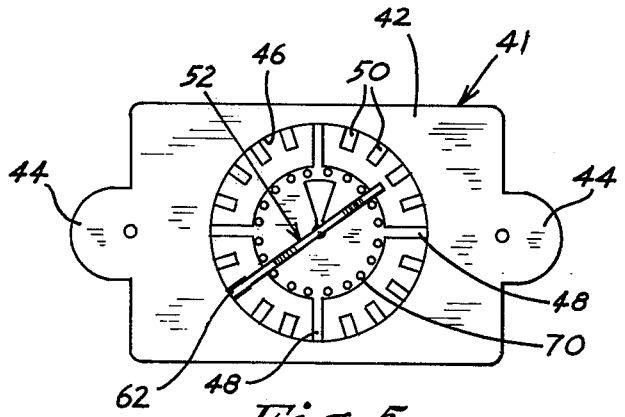
FIG. 5 is a view in front elevation of a single counter strip.
Figure 6:
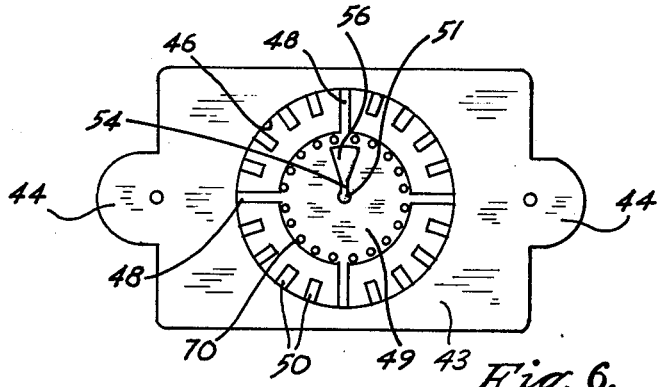
FIG. 6 is a plan view of a strip which bears a single dial member.
Figure 7:
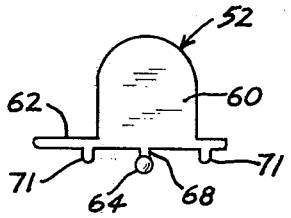
FIG. 7 is a view in elevation of a rotary indicator member alone.

An alternative and preferred form of stock control counter is illustrated in FIG. 5 and the component parts of this counter are shown in FIGS. 6 and 7.

This device is applied over a backing strip which, like the backing strip 22, bears the legends "Part No.", "Quantity" and "Date". It may be mounted like the strip 24 of FIGS. 1 to 4.

The preferred counted device 41 of FIG. 5 comprises a dial member 42 composed of celluloid or other suitable plastic. It is generally rectangular in form but may have two perforated ears 44 through which headed brads may be driven into the shelf.

The member 42 has a peripheral portion 43 and a hub 49 defining therebetween a generally circular opening 46. Four radial members 48, disposed at 90° intervals, support the central circular hub-bearing part 49. In each quadrant the space between the bounding radial members 48 is subdivided by four evenly spaced, inwardly extending counter teeth or projections 50.

The radial members 48 and the teeth 50 divide the circle into twenty equal subdivisions. Each quadrant, therefore, represents five divisions or steps, so that the radial members represent, respectively, 0, 5, 10 and 15. Since the teeth 50 between radial members 48 can be counted at a glance, the graduation of the dial thus formed by the radial members 48 and the teeth 50 with printed numbers is unnecessary.

The central circular part 49 provides support for a manually operable rotary indicator 52 of fixed length which is applied to the device before the device is put in place on the shelf.

The central, circular part of the dial member 49 is formed with a small central circular opening 51 which communicates through a narrow passage 54 with an open sector 56.

The one-piece rotary indicating member 52 has a main body portion 60, a pointer 62 and a small retaining head 64 of scant height which is connected to the body portion 60 through a narrow neck 68.

The retaining head 64 can be readily inserted through the open sector 56. When this has been done the neck portion 68 of the indicating member 52 is squeezed through the narrow passage 54 of the member 48. The indicator 52 is retained in that relationship by the narrowness of the neck 68 and the resiliency of the materials of the members 48 and 42.

The central part 49 is provided with twenty evenly spaced upstanding humps 70 which provide 20 evenly spaced notches between them, the notches being aligned with the respective radial members 48 and with the respective teeth 50. The indicator portion of the member 52 invariably engages and clicks over the humps 70 from notch to notch, being equipped on its lower face with two humps 71 for this purpose. The upstanding main body portion 60 of the indicating member 52 is seized between the thumb and index finger of the user for turning.

It is to be understood, of course, that the provision of 20 spaces per revolution is arbitrary and that the number can be varied as desired.

The device 41 can be applied with brads, as described. Alternatively, the ears can be cut off or omitted and the device can be mounted as illustrated in FIG. 3.

As many of these devices may be mounted side by side as may be desirable in connection with a single item. One of the counters 41 will take care of a maximum of 20 items; two, side by side, would suffice for 400 items; three, side by side, would suffice for 8,000 items; and four, side by side, would suffice for 160,000 items.

While the invention has been described as used for counting up the number of packages dispensed, it can, if desired, be operated in a reverse fashion. The indicator can be set to show the initial content of a compartment on the recorded replenishment date and can be operated to subtract one for each package withdrawn, so that the indicator always shows the number of packages on hand in the associated compartment.

I have described what I believe to be the best embodiments of my invention. What I desire to cover by letters patent, however, is set forth in the appended claims.

I claim:

1. A stock control indicator for indicating the quantity of an item is stock comprising 1. a thin, flat plastic dial member including a peripheral portion and hub defining a circular opening therebetween, said dial member further including a first plurality of equally spaced-apart radial members connecting said peripheral portion and said hub and dividing said opening into equal quadrants, additional radial members connected to the peripheral portion and extending partially across said opening between said first radial members for delineating subdivisions of said quadrants, said hub defining a central opening and a substantially larger open sector which communicate via a channel of a width less than the diameter of said central opening, said hub having a plurality of integral humps spaced-apart in a circular array concentric with said central opening, the number of humps being equal to the number of radial members; and 2. a plastic rotary indicating member extending trasnversely to said dial member and including an operating portion adapted to be grasped by a user to effect rotation thereof, an edge of said operating portion engaging and clicking over said humps when said indicating member is rotated and being contained between two adjacent humps when stationary, said indicating member having a pointer extending at least partially across said circular opening, said indicating member further including an anchoring head of a diameter larger than said central opening, said head being insertable through said open sector and being connected to the operating portion by a narrow neck portion, said neck portion being confined in said central opening and being of a thickness slightly greater than said channel such that it may be forced from said open sector through said channel and into the central opening for confinement therein;

the humps on said hub being disposed between the longitudinal axes of adjacent radial members such that when said indicating member is stationary, said pointer is substantially aligned with a radial member.

2. The indicator of claim 1 wherein the humps are disposed on the periphery of said hub.

* * * * *